US006144815A

United States Patent [19]

Chadani et al.

[11] Patent Number: 6,144,815

[45] Date of Patent: Nov. 7, 2000

[54] DEVELOPING DEVICE, PROCESS CARTRIDGE AND ELECTROPHOTOGRAPHIC IMAGE FORMING APPARATUS

[75] Inventors: Kazuo Chadani, Shizuoka-ken; Hiroomi Matsuzaki, Mishima; Akira Suzuki, Odawara, all of Japan

[73] Assignee: Canon Kabushiki Kaisha, Tokyo, Japan

[21] Appl. No.: 09/395,363

[22] Filed: Sep. 14, 1999

[30] Foreign Application Priority Data

Sep. 22, 1998 [JP] Japan ..... 10-286104

[51] Int. Cl.[7] ..... G03G 15/08; G03G 21/16

[52] U.S. Cl. ..... 399/27; 399/111; 399/61

[58] Field of Search ..... 399/24, 25, 27, 399/30, 61, 62, 63, 53, 111, 119

[56] References Cited

U.S. PATENT DOCUMENTS 5,864,731 1/1999 Ikemoto et al. ..... 399/27
5,923,917 1/1999 Sakurai et al. ..... 399/27
5,943,529 8/1999 Miyabe et al. ..... 399/111
5,946,522 8/1999 Inami ..... 399/27
5,966,567 10/1999 Matsuzaki et al. ..... 399/111
6,011,941 1/2000 Takashima et al. ..... 399/111

*Primary Examiner*—Fred L. Braun
*Assistant Examiner*—Hoang Ngo
*Attorney, Agent, or Firm*—Fitzpatrick, Cella, Harper & Scinto

[57] ABSTRACT

A developing device for developing an electrostatic latent image formed on an electrophotographic photosensitive member includes a rotatable developer bearing member bearing a developer thereon, a developer regulating member for regulating the amount of the developer born on the developer bearing member, a first rotatable developer conveying member for conveying the developer toward the developer bearing member, and a second rotatably developer conveying member. A developer-remaining-amount detecting member for detecting the amount of remaining developer is disposed in an area defined by the tangential lines of a first circle and a second circle as the loci of rotation of the first developer conveying member and the second developer conveying member as viewed from the longitudinal direction of the developer bearing member.

21 Claims, 7 Drawing Sheets

DEVELOPING DEVICE, PROCESS CARTRIDGE AND ELECTROPHOTOGRAPHIC IMAGE FORMING APPARATUS

BACKGROUND OF THE INVENTION

1. Field of the Invention

This invention relates to a developing device for use in an image forming apparatus such as a laser beam printer, a copying apparatus or a facsimile apparatus adopting an electrophotographic system, a process cartridge provided with developing means as the developing device, and an electrophotographic image forming apparatus having a main body onto which the process cartridge is detachably mountable.

2. Related Background Art

There is known an image forming apparatus, such as a laser beam printer or a copying apparatus, in which process units, such as a photosensitive drum 7, which is a latent image bearing member, a charger 8, a developing device 9 and cleaning means 10, are made integral as a process cartridge B which is easily detachably mountable onto the main body of the image forming apparatus (see FIG. 8 of the accompanying drawings).

In this process cartridge B, as a developing unit 12 constituting the developing device and means for circulating a toner (developer) T in a toner container 11, a toner feeding member 9*a*, which is developer conveying means, is disposed in the toner container 11 as shown in FIG. 8, or as shown in FIGS. 9A and 9B of the accompanying drawings, and a plurality of toner feeding members 9*a* are arranged in a row so as to feed the toner sequentially.

Here, it has come to be desired to increase the quantity of the toner contained in the process cartridge B.

The present invention is a further development of the above-described prior art.

SUMMARY OF THE INVENTION

It is an object of the present invention to provide a developing device which can well circulate a developer, a process cartridge provided with the developing device, and an electrophotographic image forming apparatus.

It is another object of the present invention to provide a developing device which can well circulate a developer so that good images may be obtained even if the quantity of the developer is great, a process cartridge provided with the developing device, and an electrophotographic image forming apparatus.

It is still another object of the present invention to provide a developing device in which a developer remaining amount detecting member for detecting the remaining amount of developer is disposed in an area defined by the tangential lines of a first circle and a second circle as the loci of rotation of a first developer conveying member and a second developer conveying member as viewed from a longitudinal direction of a developer bearing member, a process cartridge provided with the developing device, and an electrophotographic image forming apparatus.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Embodiments of a developing device, a process cartridge and an electrophotographic image forming apparatus according to the present invention will hereinafter be described with reference to FIGS. 1 to 7 of the accompanying drawings.

The general construction of the electrophotographic image forming apparatus A and the process cartridge B will first be described, and then the construction of the portion of the process cartridge B around a developing unit will be described.

In the present embodiment, a laser beam printer is exemplified as the electrophotographic image forming apparatus.

General Construction

Figure 3:
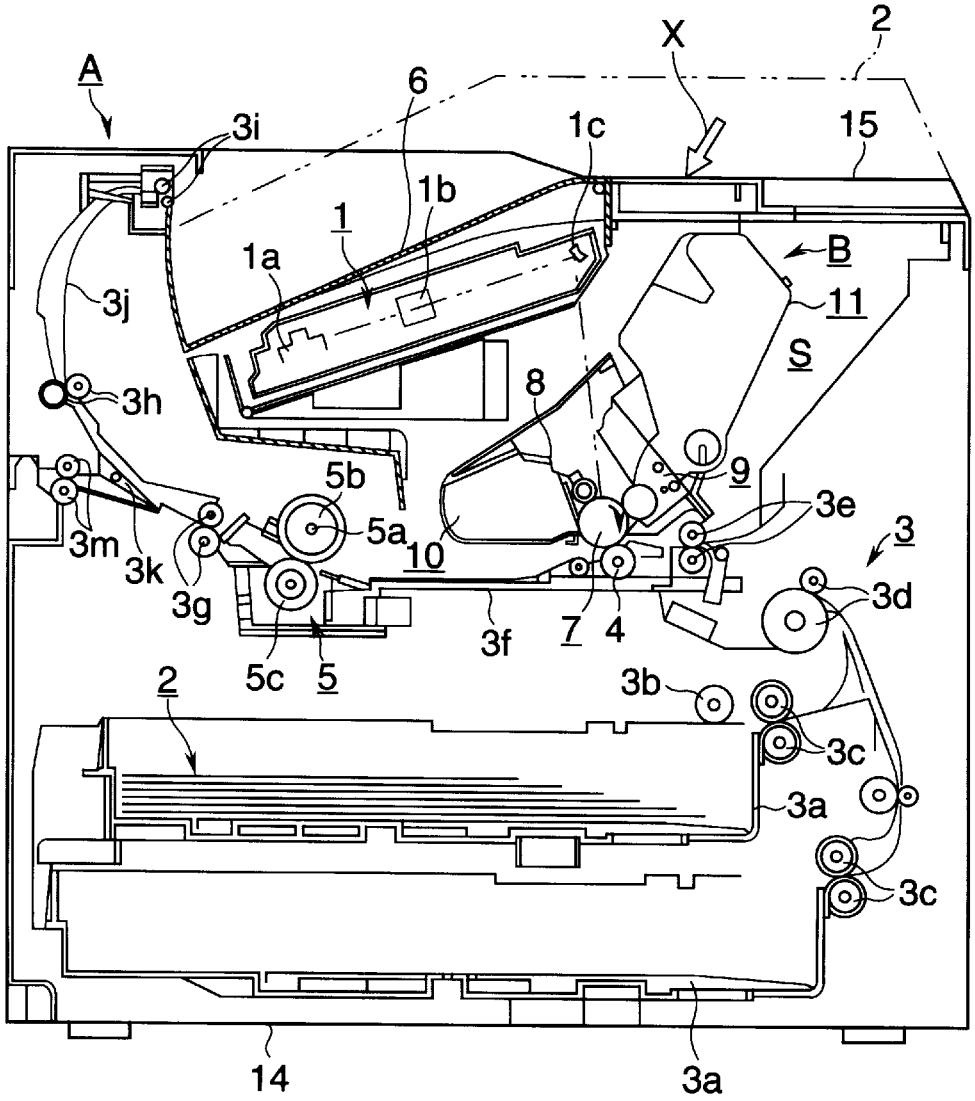
FIG. 3 is an illustration of the construction of an electrophotographic image forming apparatus according to an embodiment of the present invention.
Figure 4:
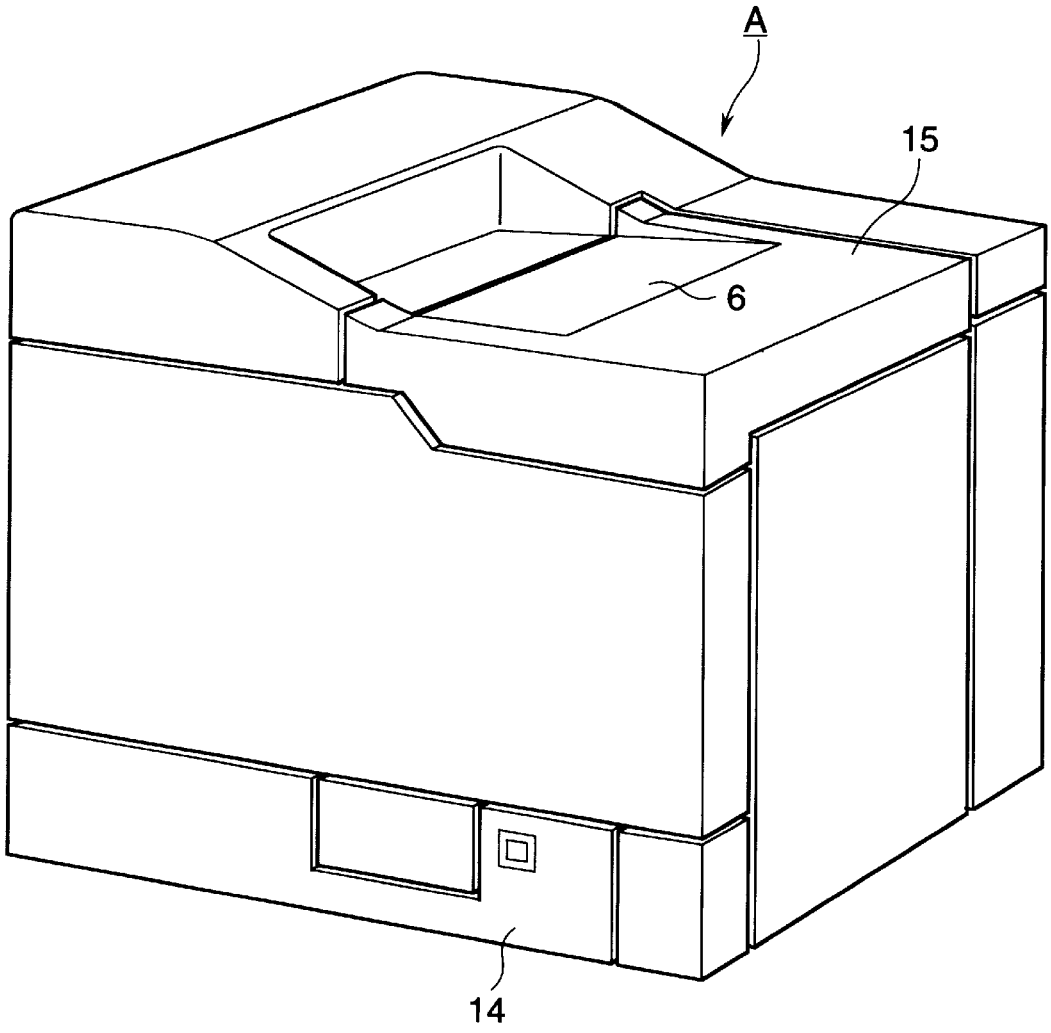
FIG. 4 is a pictorial perspective view of the electrophotographic image forming apparatus according to the embodiment.
Figure 5:
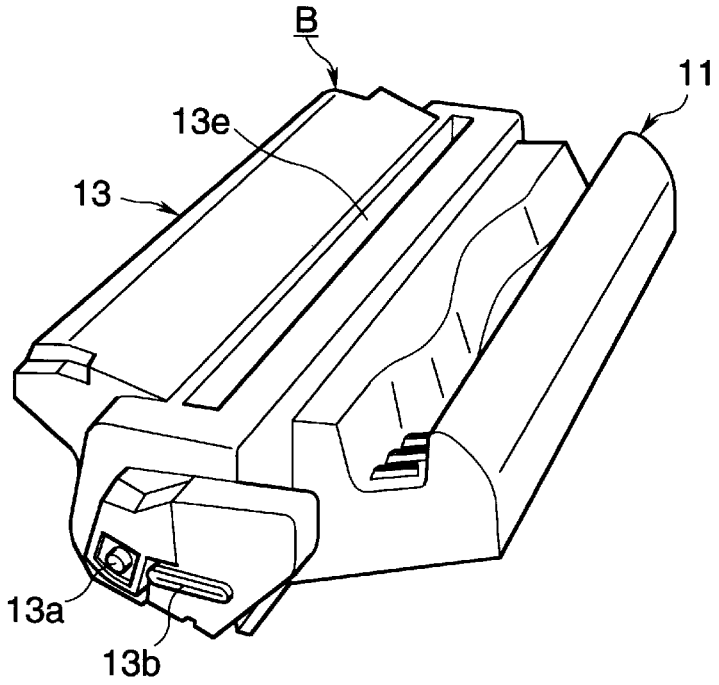
FIG. 5 is a pictorial perspective view of a process cartridge according to an embodiment of the present invention.

FIG. 3 is an illustration of the construction of the electrophotographic image forming apparatus A on which the process cartridge B is mounted, FIG. 4 is a pictorial perspective view of the electrophotographic image forming apparatus A, and FIG. 5 is a pictorial perspective view of the process cartridge B.

This electrophotographic image forming apparatus (laser beam printer) A, as shown in FIG. 3, has optical means 1 in which a rotating polygon mirror 1*a* scans a light from a laser beam source (not shown) emitting light in conformity with image information and which irradiates a photosensitive drum 7 through the intermediary of a lens 1*b* and a reflecting mirror 1*c*, and applies a light beam based on the image information from this optical means 1 to the photosensitive drum 7, as an electrophotographic photosensitive member, which is a latent image bearing member to thereby form a toner image.

In synchronism with the formation of the toner image, a recording medium 2 such as recording paper, an OHP sheet or cloth, is conveyed from a cassette 3*a* by conveying means comprising a pickup roller 3*b*, pairs of conveying rollers 3*c* and 3*d* and a pair of registering rollers 3*e* with its surface reversed, and in an image forming portion made into a cartridge as the process cartridge B, the toner image formed on the photosensitive drum 7 is transferred to the recording medium 2 by a voltage being applied to a transfer roller 4 as transfer means.

Further, after the transfer of the toner image, the recording medium 2 is conveyed to fixing means 5 comprising a fixing roller 5*b* containing a heater 5*a* therein, and a driving roller 5*c* for urging the recording medium 2 against the fixing roller 5*b* and conveying the recording medium 2 while being guided by a guide member 3*f*, whereby the transferred toner image is fixed on the recording medium 2.

This recording medium 2 is then conveyed by pairs of discharge rollers 3*g*, 3*h* and 3*i* and is discharged to a discharge portion 6 through a surface reversing and conveying path 3*j*.

Regarding the discharge, it is also possible to operate a pivotally movable flapper 3*k* and straightly discharge the recording medium by a pair of discharge rollers 3*m* without the intermediary of the surface reversing and conveying path 3*j*. In the present embodiment, the pickup roller 3*b*, the pairs of conveying rollers 3*c*, 3*d*, the pair of registering rollers 3*e*, the guide member 3*f*, the pairs of discharge rollers 3*g*, 3*h*, 3*i*, the surface reversing and conveying path 3*j*, etc. together constitute conveying means 3.

Figure 6:
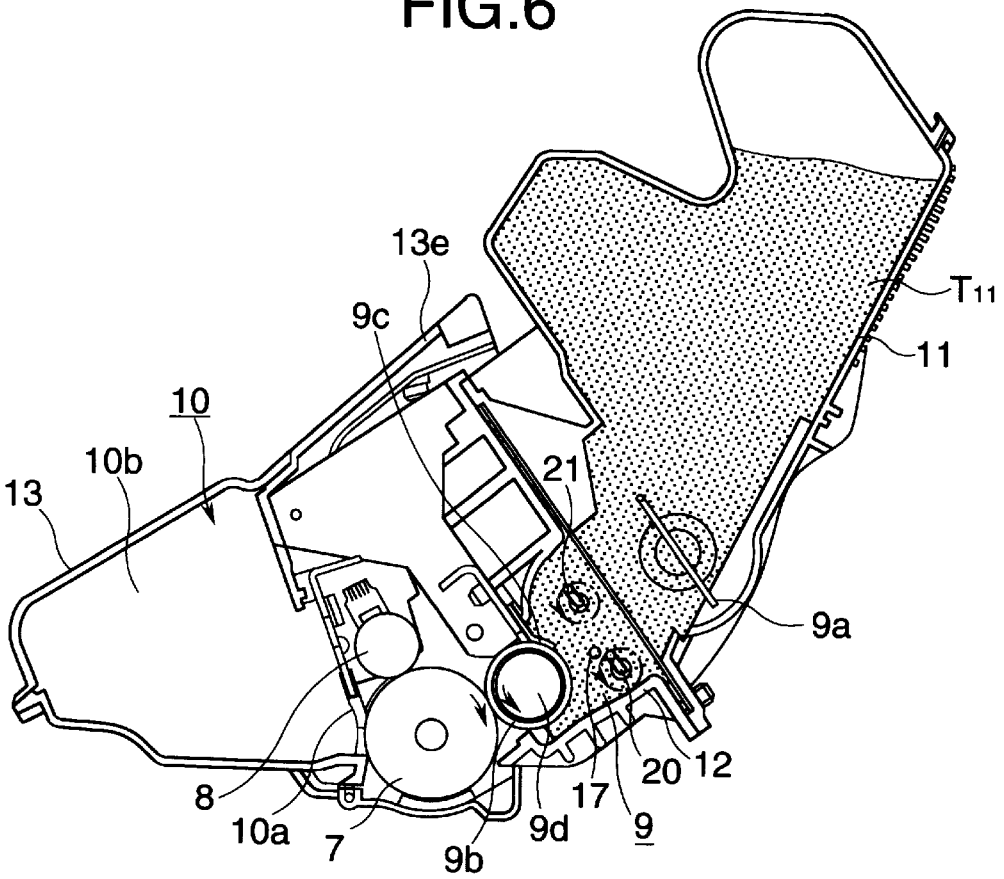
FIG. 6 is an illustration of the construction of the process cartridge according to the embodiment.

The process cartridge B used in the electrophotographic image forming apparatus A has the appearances as shown in FIG. 5, and is detachably mountable on the main body 14 of the electrophotographic image forming apparatus by a cover 15 shown in FIG. 4 being opened. As shown in FIG. 6, the photosensitive drum 7 as an electrophotographic photosensitive member, which is an electrostatic latent image bearing member having a photosensitive layer, is rotatably disposed in the process cartridge B, and the surface thereof may be uniformly charged by the application of a voltage to a charging roller 8, which is charging means, and the optical image from the optical means 1 may be exposed on the photosensitive drum 7 through an exposure portion 13*e* to thereby form a latent image, which may then be developed by developing means 9, which is a developing device.

The developing means 9 is such that a toner T11, which is a developer in a toner container 11, is fed out by a toner feeding member 9*a*, which is a developer conveying member, and a developing roller 9*b*, which is a developer bearing member containing a stationary magnet 9*d* therein, and a toner layer having triboelectrification charges imparted thereto is formed on the surface of the developing roller 9*b* by a developing blade 9*c* which is a developer regulating member, and the toner is transferred to the photosensitive drum 7 in conformity with the latent image to thereby form and visualize the toner image.

After a voltage of the opposite polarity to the toner image is applied to the transfer roller 4 and the toner image is transferred to the recording medium 2, the toner residual on the photosensitive drum 7 may be scraped off by a cleaning blade 10*a* and the residual toner on the photosensitive drum 7 may be removed by cleaning means 10 for collecting the residual toner into a waste toner reservoir 10*b*.

Also, an antenna rod 17 which is a developer remaining amount detecting member for detecting the amount of remaining toner is provided at a predetermined distance from the developing roller 9*b*. The electrostatic capacity between this antenna rod 17 and the developing roller 9*b* is changed by the amount of toner present between the two, and this change in the electrostatic capacity is detected as a change in the potential difference by the main body 14 of the image forming apparatus, whereby the amount of remaining toner is detected. That is, a change in the electrostatic capacity created between the antenna rod 17 and the developing roller 9*b* when a developing bias is applied from the main body 14 of the image forming apparatus to the developing roller 9*b* is detected as a change in the potential difference by the main body 14 of the image forming apparatus to thereby detect the amount of remaining toner.

The process cartridge B shown in the present embodiment is a cartridge comprising the photosensitive drum 7, the charging roller 8, the developing means 9 and the cleaning means 10 contained in a housing comprising the toner container 11 containing the toner therein and the developing unit 12 coupled together, and further a cleaning container 13 is coupled thereto. This process cartridge B is detachably mounted with respect to cartridge mounting guides, not shown, which is mounting means provided in the main body 14 of the apparatus. Particularly, the cartridge mounting guides are provided on the left and right inner sides of a cartridge mounting space S appearing by the cover 15 shown in FIGS. 3 and 4 being opened. These left and right mounting guides are provided with groove-like guide portions inclined in the direction of arrow X indicated in FIG. 3, and guide convex guides 13*a* and 13*b* are provided on the left and right end portions of the housing of the process cartridge B shown in FIG. 5 (in FIG. 5, only the convex guides 13*a* and 13*b* on the left end portion are shown and the convex guides 13*a* and 13*b* on the right end portion are not shown). The process cartridge B is inserted in the direction of arrow X in FIG. 3 along these guide portions and the cover 15 is closed, whereby the mounting of the process cartridge B onto the main body 14 of the apparatus is completed.

Developing Means

A description will now be provided of the construction of the developing means 9 which is a developing device.

Figure 1:
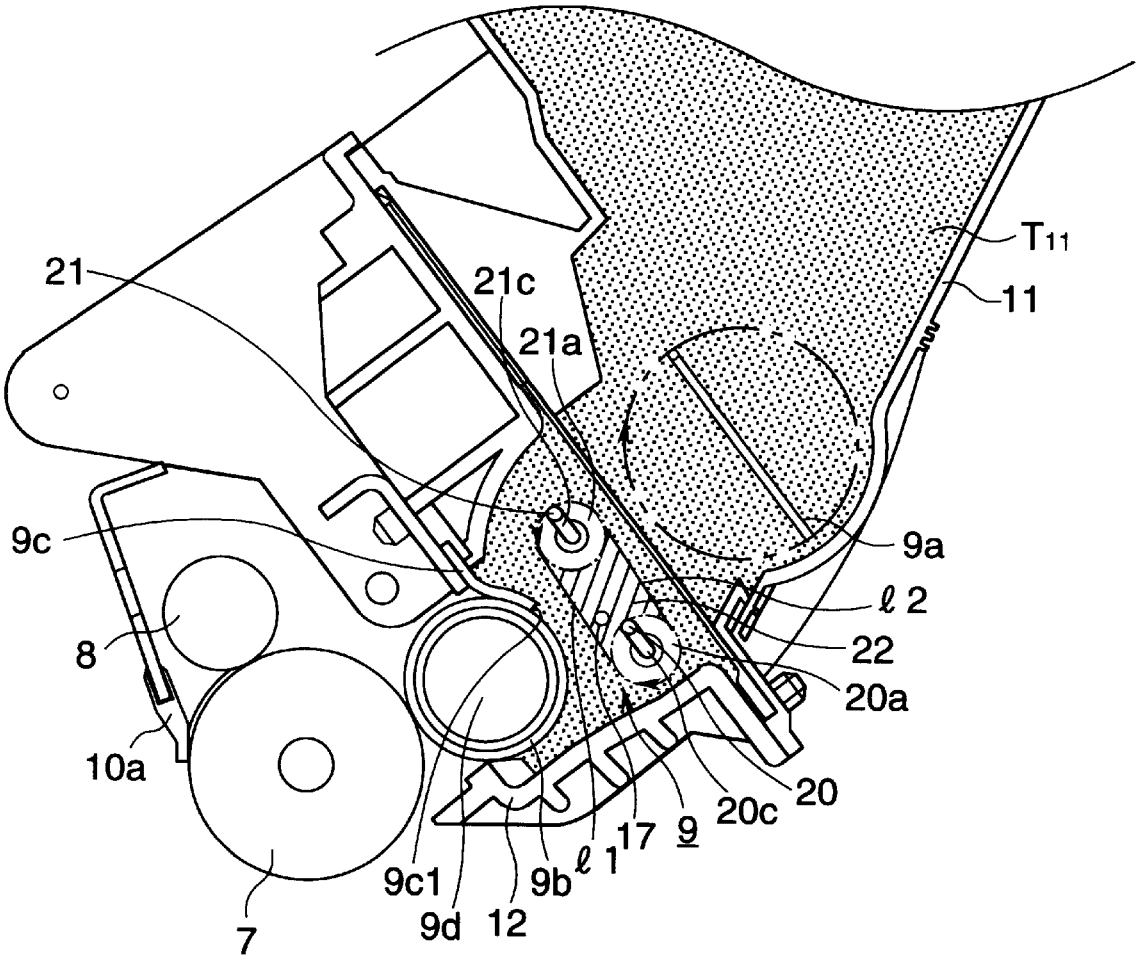
FIG. 1 is an illustration of the construction of a developing device according to an embodiment of the present invention.
Figure 7:
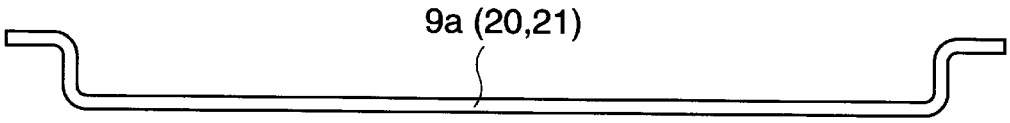
FIG. 7 shows a shape of a toner feeding member.
Figure 8:
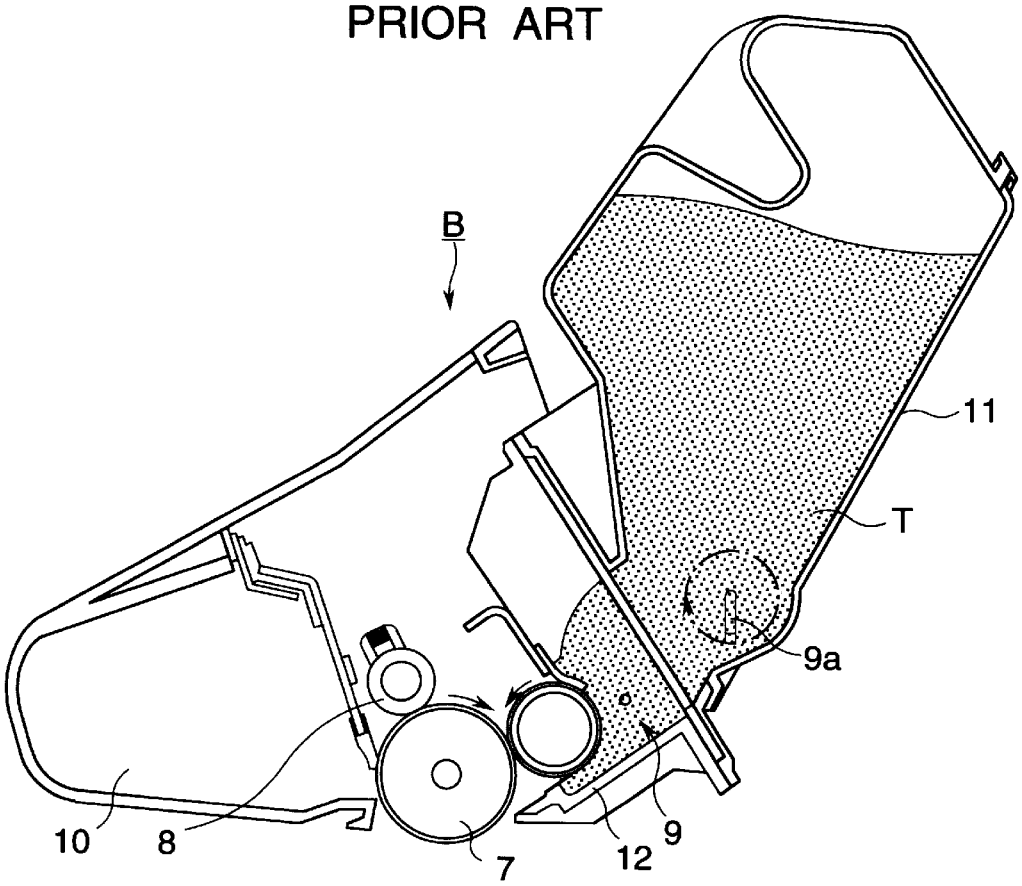
FIG.8 PRIOR ART
FIG. 8 is a cross-sectional view of a process cartridge according to the prior art.
Figure 9A:
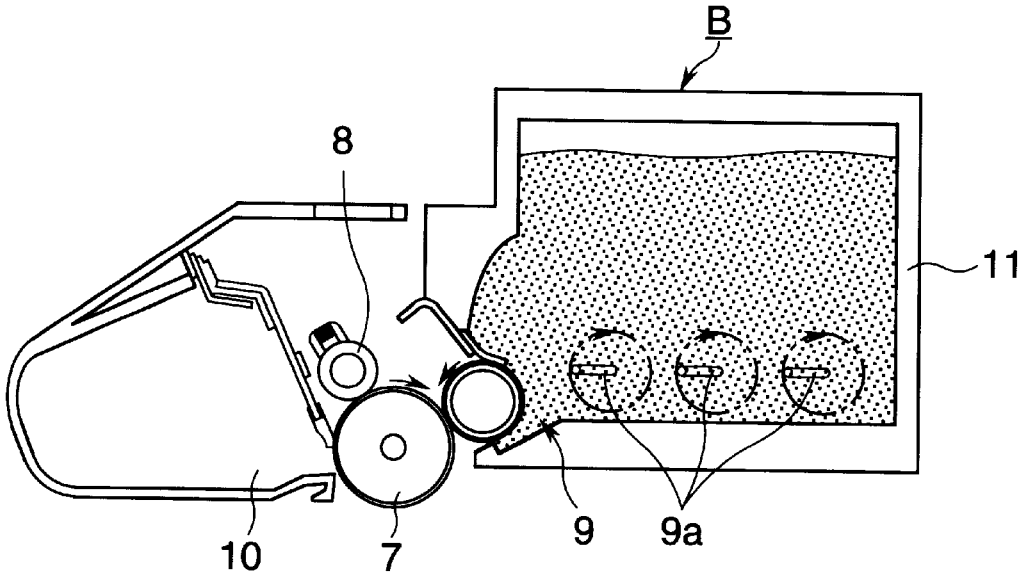
FIG.9A PRIOR ART
FIGS. 9A and 9B are cross-sectional views of the process cartridge according to the prior art.
Figure 9B:
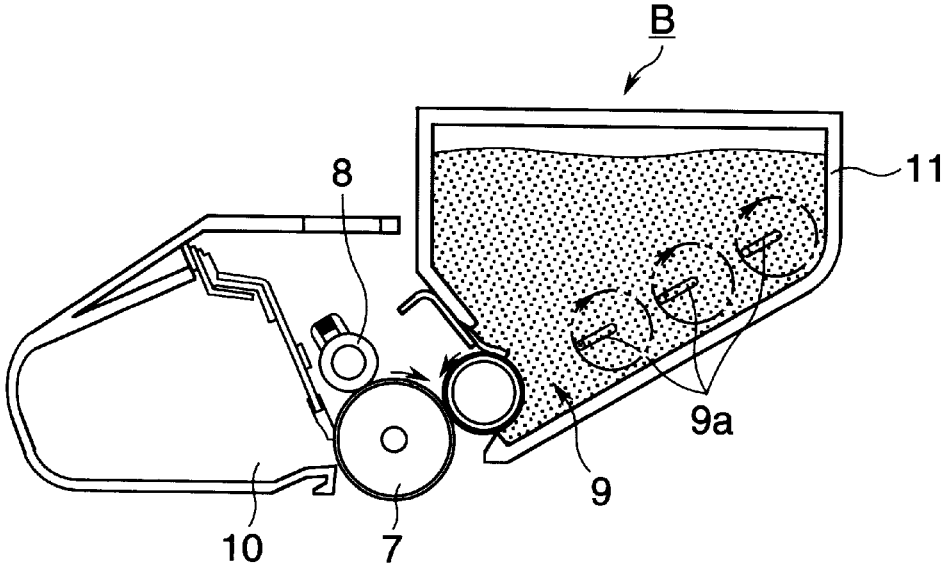
FIG.9B PRIOR ART

The toner feeding member 9*a*, which is developer conveying means, in the toner container 11, two toner feeding members 20 and 21, which are developer conveying means (developer conveying members) in the developing unit 12, and the developing roller 9*b* are rotated in the directions of respective arrows indicated in FIG. 6. That is, the toner feeding member 20, which is one developer conveying member (a first developer conveying member), is rotated in the direction opposite to the direction of rotation of the developing roller 9*b* to thereby convey the toner toward the developing roller 9*b*. The toner feeding member 21, which is the other developer conveying member (a second developer conveying member), is rotated in the same direction as the direction of rotation of the developing roller 9*b* to thereby convey the toner toward the developing roller 9*b*. The toner feeding members 9*a*, 20 and 21 are of a crank-like shape as shown in FIG. 7, and as regards the speeds of the rotation thereof, the toner feeding member 21 is fastest, and the toner feeding member 20 is second fastest, and the toner feeding member 9*a* is slowest. Also, as shown in FIG. 1, the toner feeding member 21 is provided so that the center of rotation 21*c* thereof may be located downstream of the free end 9*c*1 of the developing blade 9*c* with respect to the direction of rotation of the developing roller, and the toner feeding member 20 is provided so that the center of rotation 20*c* thereof may be located upstream of the free end 9*c*1 of the developing blade 9*c* with respect to the direction of rotation of the developing roller. Also, the antenna rod 17 is disposed in an area 22 defined by parallel tangential lines of the outer diameters of rotation of the toner feeding member 21 and the toner feeding member 20. That is, the antenna rod 17 is disposed so that the cross-section thereof intersecting with the longitudinal direction of the antenna rod 17 may be located in the area 22 defined by the tangential lines l1 and l2 of a first circle 20*a* and a second circle 21*a* as the loci of rotation of the toner feeding member (first developer conveying member) 20 and the toner feeding member (second developer conveying member) 21 as viewed from the longitudinal direction of the developing roller 9*b*. Here, the area 22 defined by the aforementioned tangential lines is an area sandwiched between straight lines l1 and l2 linking together one ends and together the other ends of parallel diameters of the first circle 20*a* and the second circle 21*a* as the loci of rotation. Further, the antenna rod 17 is disposed outside the first circle and the second circle as the loci of rotation.

A description will now be provided of the circulation of the toner by the developing means 9 which is the developing device.

Figure 2:
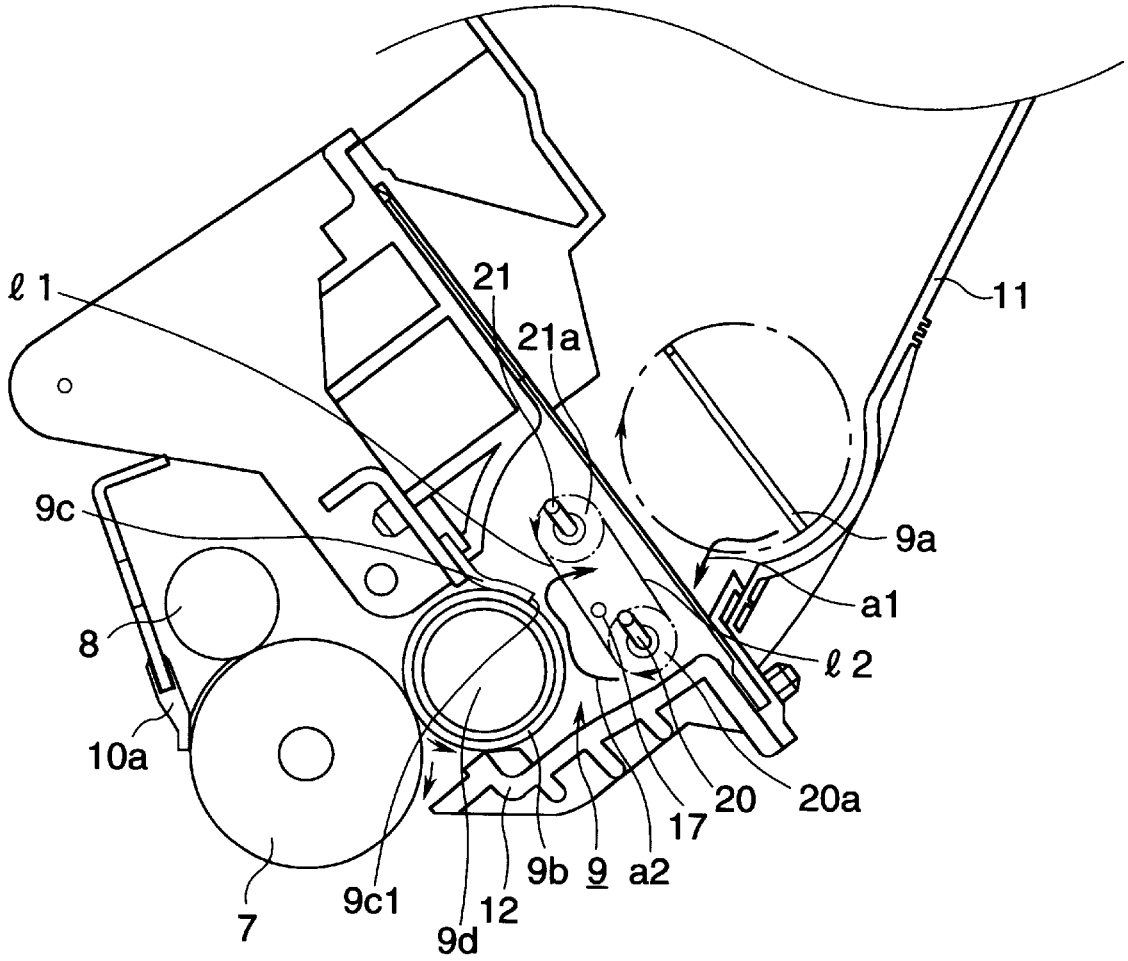
FIG. 2 represents the circulation of a toner by the developing device according to the embodiment.

As shown in FIG. 2, the toner T11 moved from the toner container 11 to the developing unit 12 in the direction of arrow a1 by the toner feeding member 9*a* is moved to the developing roller 9*h* by the toner feeding member 20 and passes the surface of the developing roller 9*b* and the vicinity thereof, and some of the toner is rotated with the developing roller 9*b* while being borne thereon and is moved to the developing portion opposed to the photosensitive drum 7, and the remainder of the toner is moved in the direction of arrow a2 from the free end 9*c*1 of the developing blade 9*c* by the toner feeding member 21. The toner is again moved toward the developing roller 9*b* by the toner feeding member 20, and the toner T11 is circulated near the developing roller 9*b*. Since the antenna rod 17 is in the area 22 indicated by hatching in FIG. 1, the toner T11 near the antenna rod 17 is circulated by the rotation of the toner feeding members 20 and 21.

That is, on the upstream side of the free end 9*c*1 of the developing blade 9*c* with respect to the direction of rotation of the developing roller 9*b*, in addition to the toner feeding member 20, the rotation of the developing roller 9*b* functions as means for moving the toner and therefore, by the toner feeding member 21 on the downstream side being rotated rapidly, the toner T11 can be moved against the toner conveying forces (developer conveying forces) of both of the toner feeding member 20 and the developing roller 9*b* to thereby circulate the toner without forcing the toner into the upper portion of the free end 9*c*1 of the developing blade 9*c*.

The dimensions and rotating speeds of the constituent members of the developing device and the process cartridge according to the present embodiment and the amount of toner will be shown below. The outer diameter and rotating speed of the photosensitive drum 7 are 30 mm and 91 r.p.m., respectively, the outer diameter and rotating speed of the developing roller 9*b* are 20 mm and 163 r.p.m., respectively, the outer diameter of rotation (dots-and-dash line in FIG. 2) and rotating speed of the toner feeding member 9*a* are 30 mm and 10 r.p.m., respectively, the outer diameter of rotation (dots-and-dash line in FIG. 2) and rotating speed of the toner feeding member 20 are 9 mm and 31.3 r.p.m., respectively, and the outer diameter of rotation (dots-and-dash line in FIG. 2) and rotating speed of the toner feeding member 21 are 9 mm and 94.4 r.p.m., respectively. The amount of toner is 1100 g in a range 301 mm in which the cross-sectional shape of the developing device shown in FIG. 1 continues in a direction perpendicular to the plane of the drawing sheet of FIG. 1.

As described above, according to the present invention, the toner T11 can be circulated in the directions of rotation of the toner feeding member 20, which is one developer conveying member (first developer conveying member), and the toner feeding member 21, which is the other developer conveying member (second developer conveying member), without being hampered by the antenna rod 17, which is the developer-remaining-amount detecting member and therefore, even if the amount of toner is great, the toner can be sufficiently circulated, and development can be effected without causing fading (a so-called fading phenomenon in which the toner cannot be sufficiently circulated when the amount of toner contained in the process cartridge is increased, and the image fades when the copy printing operation of the main body of the image forming apparatus is continued). Also, by the rotating speed of the toner feeding member 21 being made higher than the rotating speed of the toner feeding member 20, the toner feeding member 21 moves the toner T11 against the toner conveying forces of both of the toner feeding member 20 and the developing roller 9*b*, which is the developer bearing member, and the toner T11 is circulated without being forced into the upper portion of the free end 9*c*1 of the developing blade 9*c*, which is the developer regulating member, and the toner near the antenna rod 17 is also agitated and therefore, even if the amount of toner is great, the toner can be sufficiently circulated and image formation free of fading becomes possible. Accordingly, good images can always be obtained.

Other Embodiments

While in the above-described embodiment, a case where the developing device is applied to the process cartridge B has been exemplified, the developing device according to the present invention is not restricted thereto, but can suitably be applied, for example, as the developing means of a developing unit in which a toner container and developing means are made integral with each other.

Also, the process cartridge B shown in the aforedescribed embodiment has been exemplified with respect to a case where monochromatic images are formed, whereas the process cartridge according to the present invention can also be applied to a cartridge provided with a plurality of developing means to thereby form an image of plural colors (e.g. a two-color image, a three-color image or a full color image).

Further, the electrophotographic photosensitive member is not restricted to the photosensitive drum 7, but includes the following. First, a photoconductor is used as the photosensitive member, and the photoconductor includes, e.g. amorphous silicon, amorphous selenium, zinc oxide, titanium oxide and an organic photoconductor (OPC). Also, for example, a drum shape or a belt shape is used as the shape for carrying the photosensitive member thereon, and for example, in a drum-type photosensitive member, a photoconductor is deposited by evaporation or otherwise applied onto a cylinder of an aluminum alloy or the like.

Also, as the developing method, use can be made of one of various developing methods, such as conventional two-component, magnetic-brush development, cascade development, touch-down development and cloud development.

Also, while in the aforedescribed embodiment, the so-called contact-charging method is used as the construction of charging means, use may of course be made of a construction heretofore used in which a metallic shield of aluminum or the like is provided on the three sides of a tungsten wire, and positive or negative ions created by a high voltage being applied to the tungsten wire are moved to the surface of the photosensitive drum to thereby uniformly charge the surface of the drum.

The charging means is not limited to the roller type, but may be of the blade (charging blade) type, the pad type, the block type, the rod type, the wire type or the like.

Also, as the cleaning method for the toner residual on the photosensitive drum, a blade, a fur brush, a magnetic brush or the like may be used to constitute the cleaning means.

Also, the aforedescribed process cartridge B is provided, for example, with an electrophotographic photosensitive member and developing means and at least one of process means. Accordingly, the embodiment of the process cartridge is not restricted to the aforedescribed embodiment, but may be an embodiment in which for example, the electrophotographic photosensitive member, the developing means and the charging means are integrally made into a cartridge detachably mountable to the main body of an image forming apparatus, an embodiment in which the electrophotographic photosensitive member and the developing means are integrally made into a cartridge detachably mountable to the main body of an image forming apparatus, or an embodiment in which the electrophotographic photosensitive member, the developing means and the cleaning means are integrally made into a cartridge detachably mountable to the main body of an image forming apparatus.

Further, while in the aforedescribed embodiment, a laser beam printer is exemplified as an electrophotographic image forming apparatus as an image forming apparatus, the present invention need not be restricted thereto, but can of course be used in an electrophotographic image forming apparatus such as an electrophotographic copying apparatus, a facsimile apparatus or a word processor.

As described above, according to the developing device, the process cartridge and the electrophotographic image forming apparatus of the present invention, the developer can be circulated well.

While the invention has been described with respect to the structures disclosed herein, it is not confined to the details set forth and this application is intended to cover such modifications or changes as may come within the purposes of the improvements or the scope of the appended claims.

What is claimed is:

1. A developing device for developing an electrostatic latent image formed on an electrophotographic photosensitive member, said developing device comprising:

a rotatable developer bearing member bearing a developer thereon;

a developer regulating member for regulating an amount of the developer borne on said developer bearing member;

a first rotatable developer conveying member for conveying the developer toward said developer bearing member;

a second rotatable developer conveying member; and a developer-remaining-amount detecting member for detecting an amount of remaining developer and disposed in an area defined by tangential lines of a first circle and a second circle as loci of rotation of said first developer conveying member and said second developer conveying member as viewed from a longitudinal direction of said developer bearing member.

2. A developing device according to claim 1, wherein said first developer conveying member is disposed so as to be located upstream of a free end of said developer regulating member with respect to a direction of rotation of said developer bearing member, and said second developer conveying member is disposed so as to be located downstream of the free end of said developer regulating member with respect to the direction of rotation of said developer bearing member.

3. A developing device according to claim 1, wherein the area defined by said tangential lines is an area sandwiched between straight lines linking together one ends and together the other ends of parallel diameters of the first circle and the second circle as said loci of rotation.

4. A developing device according to claim 1, wherein said developer-remaining-amount detecting member is disposed outside the first circle and the second circle as said loci of rotation.

5. A developing device for developing an electrostatic latent image formed on an electrophotographic photosensitive member, said developing device comprising:

a rotatable developer bearing member bearing a developer thereon;

a developer regulating member for regulating an amount of the developer borne on said developer bearing member;

a first rotatable developer conveying member for conveying the developer toward said developer bearing member;

a second rotatable developer conveying member; and a developer-remaining-amount detecting member for detecting an amount of remaining developer and disposed in an area defined by tangential lines of a first circle and a second circle as loci of rotation of said first developer conveying member and said second developer conveying member as viewed from a longitudinal direction of said developer bearing member, wherein a rotating speed of said second developer conveying member is higher than a rotating speed of said first developer conveying member.

6. A developing device according to claim 5, wherein said first developer conveying member is disposed so as to be located upstream of a free end of said developer regulating member with respect to a direction of rotation of a developer bearing member, and said second developer conveying member is disposed so as to be located downstream of the free end of said developer regulating member with respect to the direction of rotation of said developer bearing member.

7. A developing device according to claim 5, wherein the area defined by said tangential lines is an area sandwiched between straight lines linking together one ends and together the other ends of parallel diameters of the first circle and the second circle as said loci of rotation.

8. A developing device according to claim 5, wherein said developer-remaining-amount detecting member is disposed outside the first circle and the second circle as said loci of rotation.

9. A developing device according to claim 1 or 5, wherein a direction of rotation of said first developer conveying member and a direction of rotation of said developer bearing member are opposite to each other, and a direction of rotation of said second developer conveying member and the direction of rotation of said developer bearing member are the same.

10. A process cartridge detachably mountable onto a main body of an electrophotographic image forming apparatus, said process cartridge comprising:

an electrophotographic photosensitive member; and developing means for developing an electrostatic latent image formed on said electrophotographic photosensitive member, said developing means including: a rotatable developer bearing member bearing a developer thereon; and a developer regulating member for regulating an amount of the developer borne on said developer bearing member;

a first rotatable developer conveying member for conveying the developer toward said developer bearing member;

a second rotatable developer conveying member; and a developer-remaining-amount detecting member for detecting an amount of remaining developer and disposed in an area defined by tangential lines of a first circle and a second circle as loci of rotation of said first developer conveying member and said second developer conveying member as viewed from a longitudinal direction of said developer bearing member.

11. A process cartridge according to claim 10, wherein said first developer conveying member is disposed so as to be located upstream of a free end of said developer regulating member with respect to a direction of rotation of said developer bearing member, and said second developer conveying member is disposed so as to be located downstream of the free end of said developer regulating member with respect to the direction of rotation of said developer bearing member.

12. A process cartridge according to claim 10, wherein the area defined by said tangential lines is an area sandwiched between straight lines linking together one ends and together the other ends of parallel diameters of the first circle and the second circle as said loci of rotation.

13. A process cartridge according to claim 10, wherein said developer-remaining-amount detecting member is disposed outside the first circle and the second circle as said loci of rotation.

14. A process cartridge detachably mountable onto a main body of an electrophotographic image forming apparatus, said process cartridge comprising:

an electrophotographic photosensitive member; and developing means for developing an electrostatic latent image formed on said electrophotographic photosensitive member, said developing means including: a rotatable developer bearing member bearing a developer thereon, a developer regulating member for regulating an amount of the developer borne on said developer bearing member; a first rotatable developer conveying member for conveying the developer toward said developer bearing member; a second rotatable developer conveying member; and a developer-remaining-amount detecting member for detecting an amount of remaining developer and disposed in an area defined by tangential lines of a first circle and a second circle as loci of rotation of said first developer conveying member and said second developer conveying member as viewed from a longitudinal direction of said developer bearing member, wherein a rotating speed of said second developer conveying member is higher than a rotating speed of said first developer conveying member.

15. A process cartridge according to claim 14, wherein said first developer conveying member is disposed so as to be located upstream of a free end of said developer regulating member with respect to a direction of rotation of said developer bearing member, and said second developer conveying member is disposed so as to be located downstream of the free end of said developer regulating member with respect to the direction of rotation of said developer bearing member.

16. A process cartridge according to claim 14, wherein the area defined by said tangential lines is an area sandwiched between straight lines linking together one ends and together the other ends of parallel diameters of the first circle and the second circle as said loci of rotation.

17. A process cartridge according to claim 14, wherein said developer-remaining-amount detecting member is disposed outside the first circle and the second circle as said loci of rotation.

18. A process cartridge according to claim 10 or 14, wherein a direction of rotation of said first developer conveying member and a direction of rotation of said developer bearing member are opposite to each other, and a direction of rotation of said second developer conveying member and the direction of rotation of said developer bearing member are the same.

19. A process cartridge according to claim 10 or 14, wherein in addition to said electrophotographic photosensitive member and said developing means, at least one of charging means for charging said electrophotographic photosensitive member and cleaning means for removing residual developer remaining on said electrophotographic photosensitive member is integrally made into a cartridge detachably mountable onto the main body of said electrophotographic image forming apparatus.

20. An electrophotographic image forming apparatus onto which a process cartridge is detachably mountable for forming an image on a recording medium, said electrophotographic image forming apparatus comprising:

(a) mounting means for detachably mounting the process cartridge, the process cartridge including: an electrophotographic photosensitive member; and developing means for developing an electrostatic latent image formed on said electrophotographic photosensitive member, said developing means having: a rotatable developer bearing member bearing a developer thereon; a developer regulating member for regulating an amount of the developer borne on said developer bearing member; a first rotatable developer conveying member for conveying the developer toward said developer bearing member; a second rotatable developer conveying member; and a developer-remaining-amount detecting member for detecting an amount of remaining developer and disposed in an area defined by tangential lines of a first circle and a second circle as loci of rotation of said first developer conveying member and said second developer conveying member as viewed from a longitudinal direction of said developer bearing member; and (b) conveying means for conveying said recording medium.

21. An electrophotographic image forming apparatus onto which a process cartridge is detachably mountable for forming an image on a recording medium, said electrophotographic image forming apparatus comprising:

(a) mounting means for detachably mounting a process cartridge, the process cartridge including: the electrophotographic photosensitive member; and developing means for developing an electrostatic latent image formed on said electrophotographic photosensitive member, said developing means having: a rotatable developer bearing member bearing a developer thereon; a developer regulating member for regulating an amount of the developer borne on said developer bearing member; a first rotatable developer conveying member for conveying the developer toward said developer bearing member; a second rotatable developer conveying member; and a developer-remaining-amount detecting member for detecting an amount of remaining developer and disposed in an area defined by tangential lines of a first circle and a second circle as loci of rotation of said first developer conveying member and said second developer conveying member, wherein a rotating speed of said second developer conveying member is higher than a rotating speed of said first developer conveying member; and (b) conveying means for conveying said recording medium.

* * * * *

UNITED STATES PATENT AND TRADEMARK OFFICE

CERTIFICATE OF CORRECTION

PATENT NO. : 6,144,815

DATED : November 7, 2000

INVENTOR(S): KAZUO CHADANI, ET AL.

It is certified that error appears in the above-identified patent and that said Letters Patent is hereby corrected as shown below:

COVER PAGE, AT [57] IN THE ABSTRACT:
Line 5, "born" should read --borne--.
Line 8, "rotatably" should read --rotatable--.

COLUMN 3:
Line 10, "straightly" should be deleted.
Line 11, "by" should read --in a straight direction by--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*